US006898295B2

(12) United States Patent
Inamura et al.

(10) Patent No.: US 6,898,295 B2
(45) Date of Patent: May 24, 2005

(54) STRAP-SHAPED INPUT DEVICE

(75) Inventors: Junichi Inamura, Fukushima-ken (JP); Tadamitsu Sato, Fukushima (JP)

(73) Assignee: Alps Electric Co., Ltd., Tokyo (JP)

( * ) Notice: Subject to any disclaimer, the term of this patent is extended or adjusted under 35 U.S.C. 154(b) by 1 day.

(21) Appl. No.: 10/731,314

(22) Filed: Dec. 9, 2003

(65) Prior Publication Data

US 2004/0112619 A1 Jun. 17, 2004

(30) Foreign Application Priority Data

Dec. 13, 2002 (JP) ..... 2002-362830

(51) Int. Cl.[7] ..... H04R 1/00
(52) U.S. Cl. ..... 381/385; 381/374
(58) Field of Search ..... 381/385, 376, 381/386, 374

(56) References Cited

U.S. PATENT DOCUMENTS 4,347,956 A * 9/1982 Berger ..... 224/616
5,933,511 A * 8/1999 Garth, Sr. ..... 381/367
6,178,251 B1 * 1/2001 Luchs et al. ..... 381/364
6,707,924 B1 * 3/2004 Okiebisu ..... 381/385
2004/0066949 A1 * 4/2004 Iwasa et al. ..... 381/385
2004/0082360 A1 * 4/2004 Gunter et al. ..... 455/556.1

FOREIGN PATENT DOCUMENTS

JP 2002-27079 1/2002
JP 2002-78060 3/2002

* cited by examiner

*Primary Examiner*—Hung V. Ngo
(74) *Attorney, Agent, or Firm*—Brinks Hofer Gilson & Lione

(57) ABSTRACT

An input device includes a belt-shaped strap section in which leads are buried, and connecting members for connecting the strap section in an annular form. The strap section includes a sheet-shaped membrane having a plurality of input sections, and belt-shaped clamping members that can hermetically sandwich portions of the membrane having the input sections. One end of the membrane extends from end portions of the clamping members to be connected to an external device with one of the connecting members therebetween.

16 Claims, 13 Drawing Sheets

STRAP-SHAPED INPUT DEVICE

This application claims the benefit of priority to Japanese Patent Application No. 2002-362830 herein incorporated by reference.

BACKGROUND OF THE INVENTION

1. Field of the Invention

The present invention relates to an input device, and more particularly, to an input device in which a sheet-shaped membrane can be hermetically sealed in an annular strap section.

2. Description of the Related Art

A known input device is disclosed in, for example, Japanese Unexamined Patent Application Publication No. 2002-27079. The input device has an annular strap section 51 that can be worn around the human neck or the like, as shown in FIG. 22. Earphone cables 52 are extended by a predetermined length from two positions on the upper side of the strap section 51 in the figure. The leading ends of the earphone cables 52 are connected to earphones 53.

The lower side of the annular strap section 51 in the figure is connected with a connecting member 54, and an input section (not shown) is provided in the connecting portion 54. The earphone cables 52 are buried inside the strap section 51 so that they are connected to the input section in the connecting portion 54.

A cable 55 connected to the input section is extended by a predetermined length from the connecting portion 54. The cable 55 includes an audio signal cable and a cable for transmitting signals output from the input section, and a plug (not shown) is connected to an end portion thereof.

In the known input device having such a configuration, when the plug at the end of the cable 55 is inserted in and connected to a jack (not shown) of a portable acoustic device 56, the potable acoustic device 56 can be used inside a pocket of a garment, a bag, or the like in a state in which the strap section 51 is worn around the neck and the earphones 53 are put in the ears of the operator.

By operating the input section of the connecting portion 54, for example, music recorded on a CD and the like can be played back, and the playback can be stopped.

In the above-described known input device, however, for example, when rain falls while the operator is listening to music through the earphones 53 with the strap section 51 worn around the neck outdoors by playing back a CD, water drops may enter the interior of the connecting portion 54, and may cause trouble, for example, the internal input section may be short-circuited.

In order not only to start and stop the playback operation by the portable acoustic device 56, but also to perform a plurality of adjustment operations, such as volume control or balance control, by using the input section provided in the connecting portion 54, a plurality of input sections are needed, and the size of the connecting portion 54 is increased.

Furthermore, since the earphones 53 are combined with the strap section 51 with the earphone cables 52 therebetween, when the operator is not listening to music or the like with the strap section 51 worn around the neck, the earphones 53 detached from the ears hang loose and are cumbersome.

SUMMARY OF THE INVENTION

The present invention has been made in view of the above-described problems, and embodiments of the present invention is provide an input device in which an input section provided in a strap section is reliably made waterproof, and earphones can be detachably connected to the strap section.

According to one aspect, the present invention provides an input device including a belt-shaped strap section having a lead buried therein, and a connecting member for connecting the strap section in an annular form. The strap section includes a sheet-shaped membrane having a plurality of input sections, and at least one belt-shaped clamping member that can hermetically sandwich portions of the membrane with the input sections. One end of the membrane extends from an end portion of the clamping member to be connected to an external device with the connecting member therebetween.

This allows the external device to be operated through the input sections provided in the strap section. Since the external device held in the bag or the like can be operated without being taken out, the usability is high. Moreover, since the input sections are hermetically sealed by the clamping member, water drops can be prevented from entering the input sections. Accordingly, the input device of the present invention can be used even when rain is falling.

Preferably, the clamping member includes a lead-containing portion in which the lead is buried in the longitudinal direction, and a pair of opposing clamping plates extending along the lead-containing portion to sandwich the membrane in a hermetical manner.

Therefore, it is possible to reliably seal the membrane having the input sections and to make the input sections waterproof.

Preferably, one side of each of the clamping plates is provided integrally with the lead-containing portion, the other sides of the clamping plates are spaced from each other with a predetermined distance, and the membrane is hermetically sandwiched by thermofusing the other sides of the clamping plates.

In this case, the internal membrane can be reliably sealed in a waterproof manner. Moreover, even when the clamping member is folded, the clamping plates will not be separated from each other because they are thermofused.

Preferably, the membrane is formed by folding a comb-shaped sheet substrate to form opposing portions, the input sections include contact portions provided on the opposing portions of the substrate, and an outer peripheral portion of each of the contact portions is overcoated with an insulating resist film to expose a predetermined area.

In this case, the contact portions can be produced easily, and the input sections can be formed with the contact portions facing each other with the resist film used as a spacer. Moreover, the number of components can be reduced. the input section can be used easily.

Preferably, thin portions of the clamping plates corresponding to the contact portions are elastically deformable. This improves the usability of the input sections.

Preferably, the strap section includes further includes another clamping member, and the connecting member includes a first connecting member for connecting one-end portions of the clamping members, and a second connecting member for connecting the other-end portions of the clamping members. The strap section is shaped in the annular form by connecting the clamping members with the first and second connecting members.

In this case, two short clamping members are connected in an annular form by the connecting members, and the earphone can be detachably connected to the second connecting member. Therefore, when the strap section is worn around the neck, the earphone may be detached in a non-operation state. This improves the appearance.

Preferably, the lead and the membrane extend from each of the one-end portions of the clamping members and are connected to the first connecting member, and the lead extends from each of the other-end portions of the clamping members and is connected to the second connecting member.

In this case, the input sections provided in the membrane can be connected to the switch member of the first connecting member, and the earphone can be connected to the second connecting member.

Preferably, the first connecting member has a switch member that switches the connection between the external device and the input sections of the membrane.

In this case, the external device and the input sections can be disconnected by operating the switch member. This improves the usability of the input device.

Preferably, the membrane extending from the one ends of the clamping members has a terminal to be connected to an FPC (flexible printed circuit) connector provided in the first connecting member.

Since the input sections can be connected to the external device only by inserting the terminal in the FPC connector, the assembly efficiency is enhanced.

Preferably, the second connecting member has an earphone jack to which an earphone is connected.

In this case, the earphone may be detached from the earphone jack in a non-operation state. This can improve the appearance.

Preferably, the second connecting member has a jack substrate on which the earphone jack is mounted, and hermetically seals the jack substrate therein.

In this case, the interior of the second connecting member is hermetically sealed in a waterproof fashion.

Preferably, an outer peripheral portion of the clamping member is covered with a cover member.

In this case, the appearance of the strap section can be improved, for example, by forming a pattern on the cover members.

Preferably, the cover member has marks corresponding to the input sections. Marks can be easily formed on the cover members by printing or by other means.

Preferably, the strap section is wearable around the neck, and the input sections and the switch member are positioned so as to be operated by the hand when the strap section is worn around the neck with the second connecting member placed on the neck side.

This can improve the usability of the input device.

Further objects, features and advantages of the present invention will become apparent from the following description of the preferred embodiments with reference to the attached drawings.

DESCRIPTION OF THE PREFERRED EMBODIMENTS

An input device according to the present invention will be described below with reference to the attached drawings.

Figure 1:
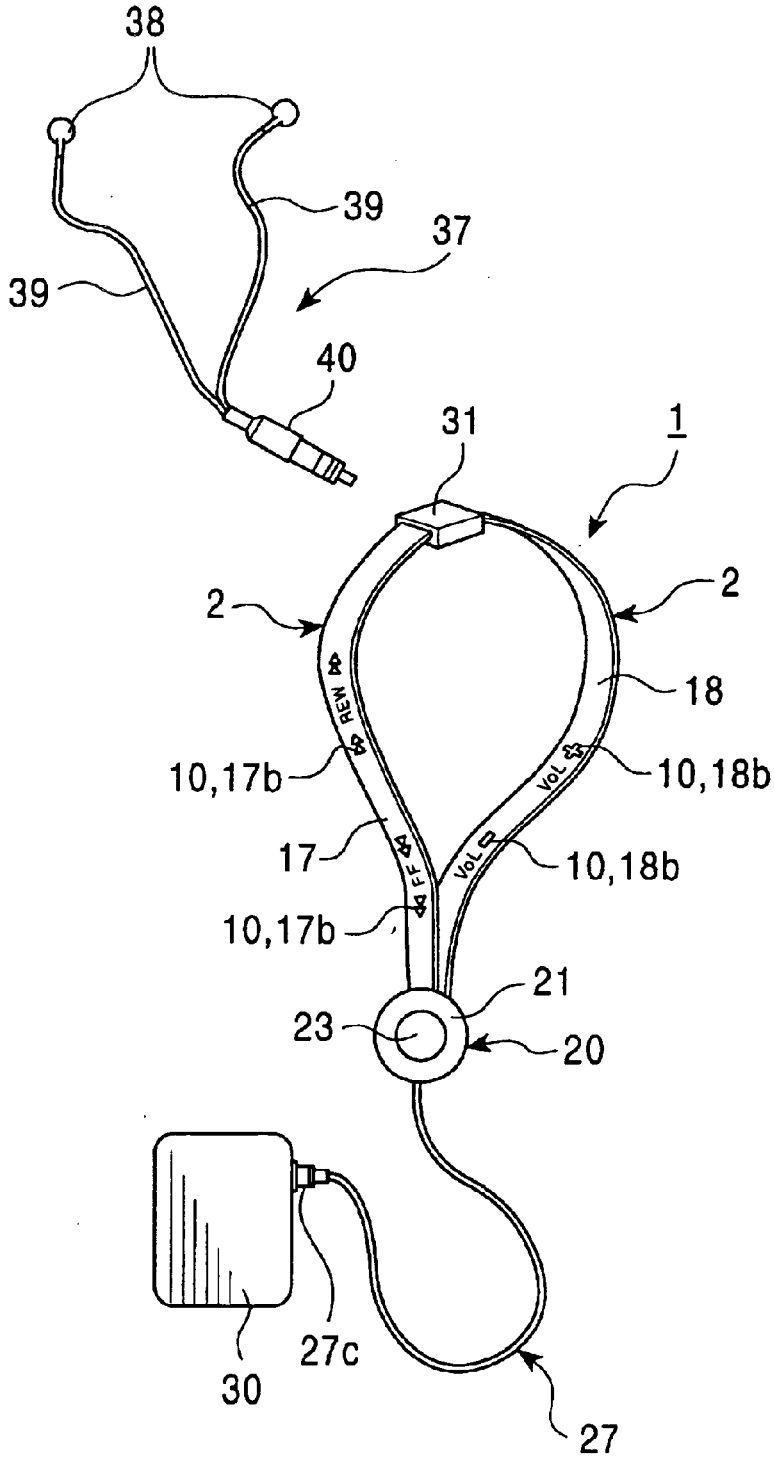
FIG. 1 is an explanatory perspective view of an input device of the present invention.

An input device 1 of the present invention is provided with a belt-shaped, flexible, and annular strap section 2 that can be worn around, for example, the human neck (neckworn), as shown in FIG. 1. The strap section 2 contains a sheet-shaped flexible membrane 3 made of a PET film or the like in a hermetically sealed manner.

Figure 2:
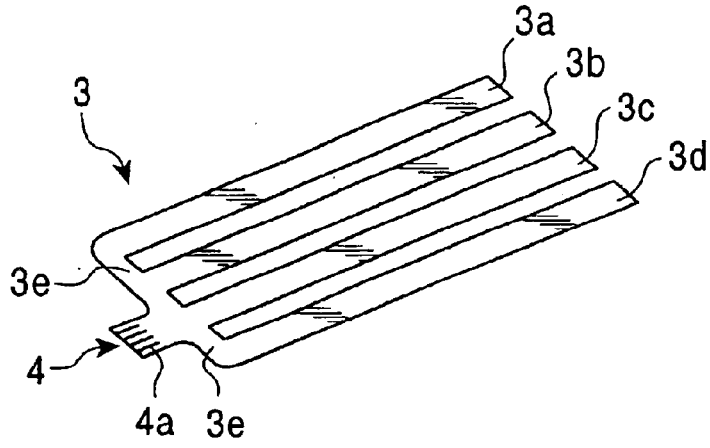
FIG. 2 is a perspective view of a membrane used in the input device.

As shown in FIG. 2, the membrane 3 is shaped like a comb in which a bar portion 3*e* is provided at the left ends in the figure of first to fourth strip-shaped substrates 3*a* to 3*d* to connect the substrates 3*a* to 3*d*.

A terminal 4 is provided at one end of the membrane 3 to protrude from the bar portion 3*e* to the left in the figure. The terminal 4 includes a plurality of circuit patterns 4*a* routed and connected to contact portions 6*a* of input sections 10, which will be described later, provided on the first to fourth substrates 3*a* to 3*d*.

Figure 4:
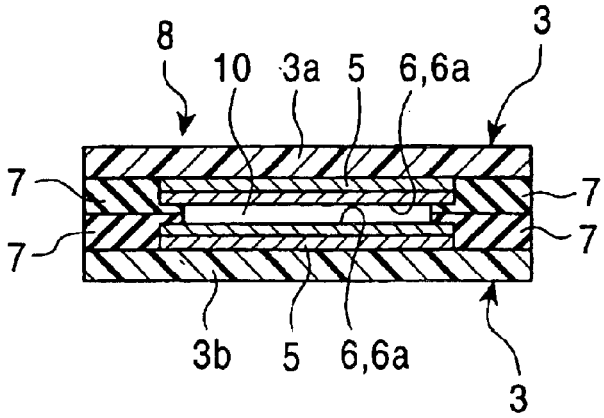
FIG. 4 is a principal sectional view showing an input section in the input device.

Silver electrodes 5 made of a good conductor film are provided on the surfaces of the first to fourth substrates 3*a* to 3*d* to be connected to the circuit patterns 4*a* of the terminal 4. Resistor layers 6 made of a resistor film are provided on the silver electrodes 5, as shown in FIG. 4.

The peripheral portions of the resistor layers 6 are overcoated with insulating resist films 7 so that predetermined areas are exposed, and the exposed areas serve as contact portions 6*a*.

A plurality of contact portions 6*a* are provided on the substrates 3*a* to 3*d* at an equal distance from the bar portion 3*e*.

Figure 3:
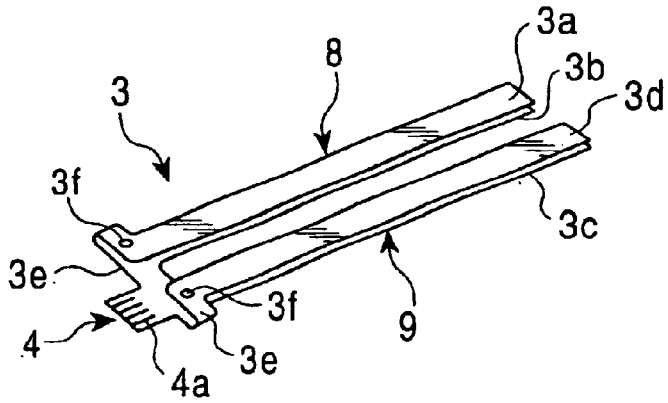
FIG. 3 is a perspective view showing a state in which the membrane shown in FIG. 2 is folded.

In such a comb-shaped membrane 3, as shown in FIG. 3, the bar portion 3*e* is folded to place the first substrate 3*a* onto the second substrate 3*b* and to place the fourth substrate 3*d* onto the third substrate 3*c*, thereby forming a first substrate unit 8 and a second substrate unit 9.

The first and second substrate units 8 and 9 have bonded portions 3*f* that are formed by bonding the bar portion 3*e*, for example, by thermobonding.

The first and second substrate units 8 and 9, herein, only the first substrate unit 8 will be described with reference to FIG. 4. The contact portions 6*a* provided on the first and second substrates 3*a* and 3*b* oppose each other with a predetermined gap therebetween by using the resist films 7 as spacers.

A section at which the contact portions 6*a* oppose each other serves as an input section 10. By pressing a portion of the first substrate 3*a* or a portion of the second substrate 3*b* corresponding to the input section 10, or both portions, the contact portions 6*a* are brought into contact with each other and electrically connected.

Because of such electric continuity between the contact portions 6*a* established by operating the input section 10, it is possible, for example, to control the volume of an external device 30 serving as a portable acoustic device, which will be described later, or to perform skipping.

Figure 8:
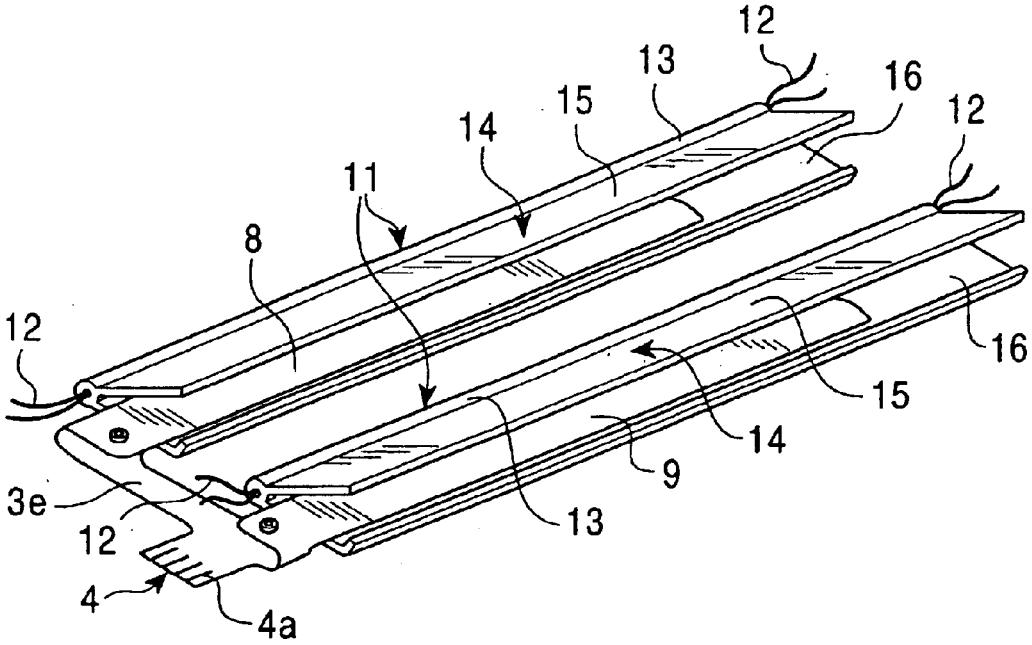
FIG. 8 is a perspective view showing the assembly of clamping members.
Figure 9:
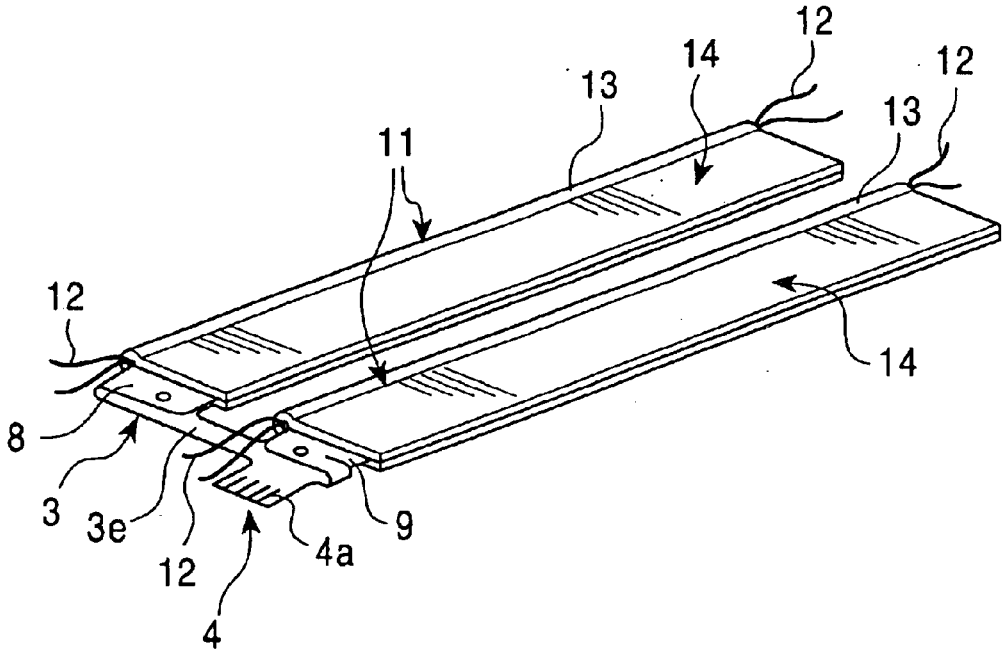
FIG. 9 is a perspective view showing the assembly of the clamping members.

The portions of the first and second substrate units 8 and 9 corresponding to the input section 10, which are formed by folding the substrates 3*a* to 3*d* at the bar portion 3*e*, can be hermetically sealed by being sandwiched by a pair of clamping members 11 shown in FIGS. 8 and 9.

Figure 5:
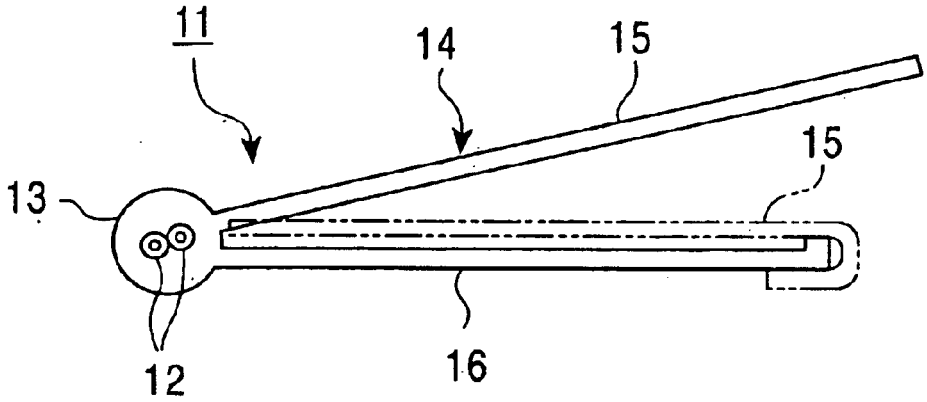
FIG. 5 is an explanatory view showing an example of a clamping member in the present invention.
Figure 6:
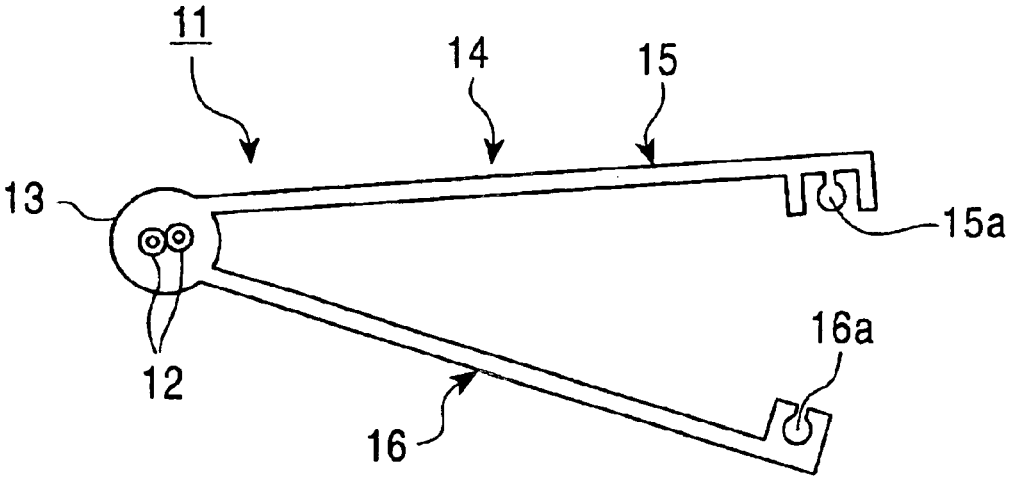
FIG. 6 is an explanatory view showing a modification of a clamping member.
Figure 7:
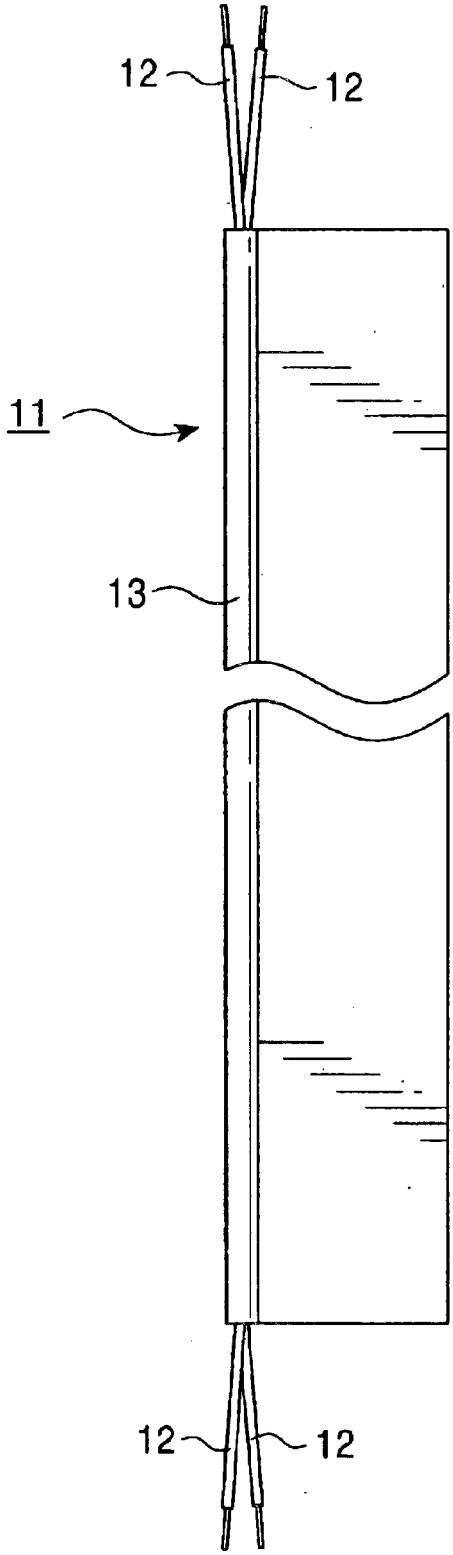
FIG. 7 is a perspective view showing the assembly of the clamping members.

Each of the clamping members 11 is composed of flexible synthetic resin, and is shaped like an elongated belt. As shown in FIGS. 5 to 7, each clamping member 11 has on its left side, a cylindrical lead-containing portion 13 in which leads 12 are buried in the longitudinal direction.

The clamping member 11 also has a membrane-sealing portion 14 along the lead-containing portion 13, in which the first substrate unit 8 or the second substrate unit 9 of the membrane 3 is placed in a hermetically sealed manner.

The membrane-sealing portion 14 includes one and the other clamping plates 15 and 16 opposing each other. As shown in FIGS. 5 and 6, left one-side portions of the clamping plates 15 and 16 are formed integrally with the lead-containing portion 13, and right other-side portions thereof are open and are spaced from each other with a predetermined gap therebetween.

As shown in FIG. 5, one of the clamping plates 15 is longer than the other clamping plate 16. The inner membrane 3 is hermetically sealed by folding the other-side portion of the clamping plate 15, as shown by a two-dot chain line, and thermofusing the other-side portions of the clamping plates 15 and 16.

For this reason, the inner membrane 3 is made waterproof, and droplets of water, such as rain, can be prevented from entering the input section 10 even when the droplets splash on the clamping member 11.

As a modification of the clamping member 11, as shown in FIG. 6, a rib 15*a* protruding at the other-side portion of one of the clamping plates 15 in parallel with the lead-containing portion 13 may be press-fitted in a groove 16*a* provided in the other clamping plate 16.

As shown in FIGS. 8 and 9, when the first and second substrate units 8 and 9 of the membrane 3 are placed between one and the other clamping plates 15 and 16 of the open clamping members 11, the leads 12 and the beam portion 3*d* at one end of the membrane 3 are extended outside the left ends of the clamping members 11. The leads 12 are also extended from the other right ends.

By tightly thermofusing the open clamping plates 15 and 16, the portions of the membrane 3 having the input sections 10 are hermetically sealed.

Consequently, the portions of the membrane 3 having the input sections 10 are made waterproof, and drops of water, such as rain, can be prevented from entering the input sections 10.

Figure 10:
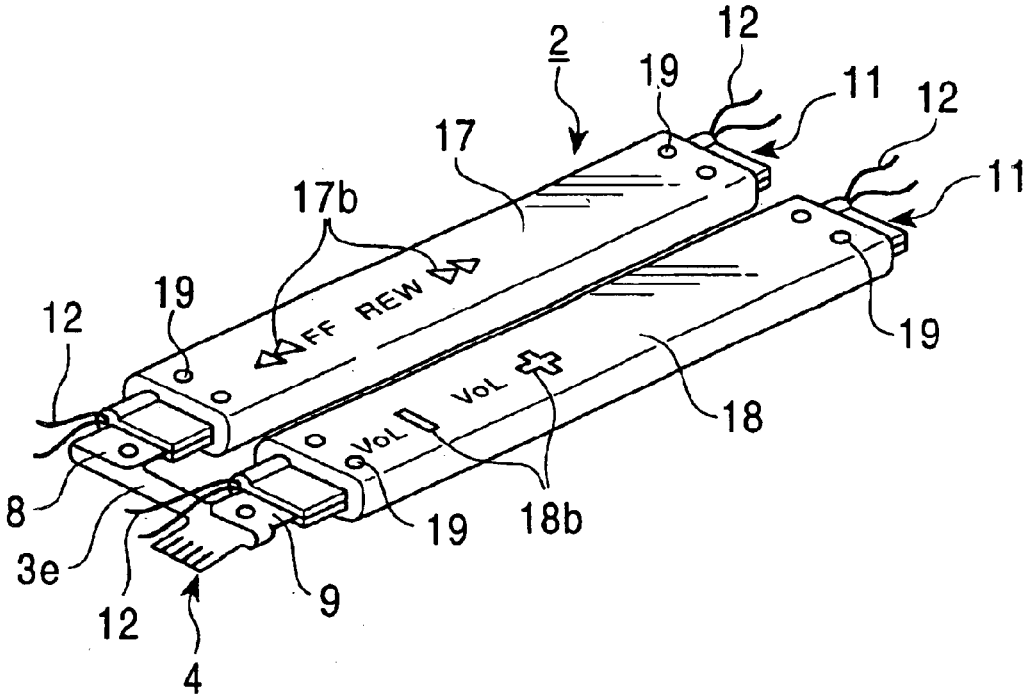
FIG. 10 is a perspective view showing the clamping members in which the membrane is hermetically sealed.

The outer peripheral portions of the clamping members 11 having the membrane 3 sealed therein are covered with cover members 17 and 18, as shown in FIG. 10. The cover members 17 and 18 are made of cloth, a flexible resin material, or the like, and the length thereof is equal to or slightly smaller than that of the clamping members 11.

Figure 11:
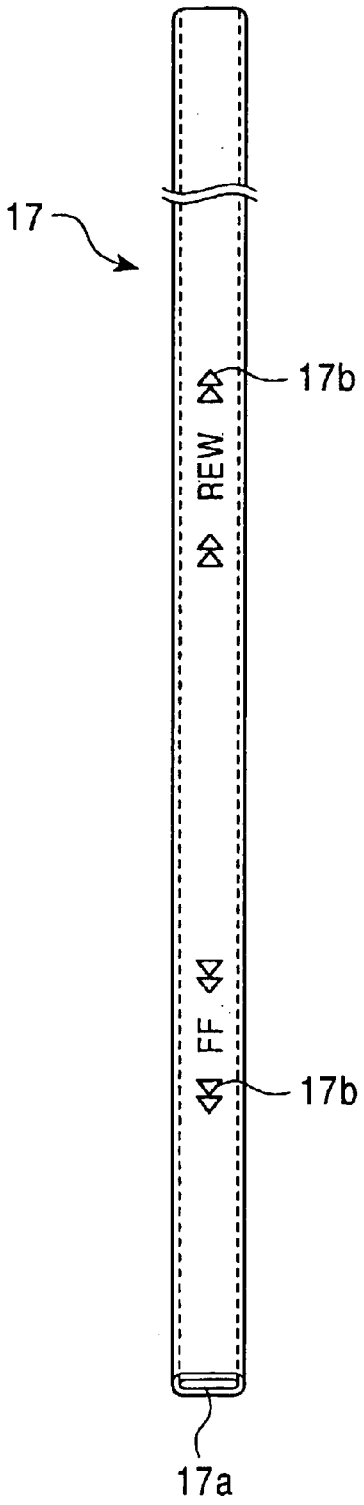
FIG. 11 is an explanatory view of one cover member in the input device.
Figure 12:
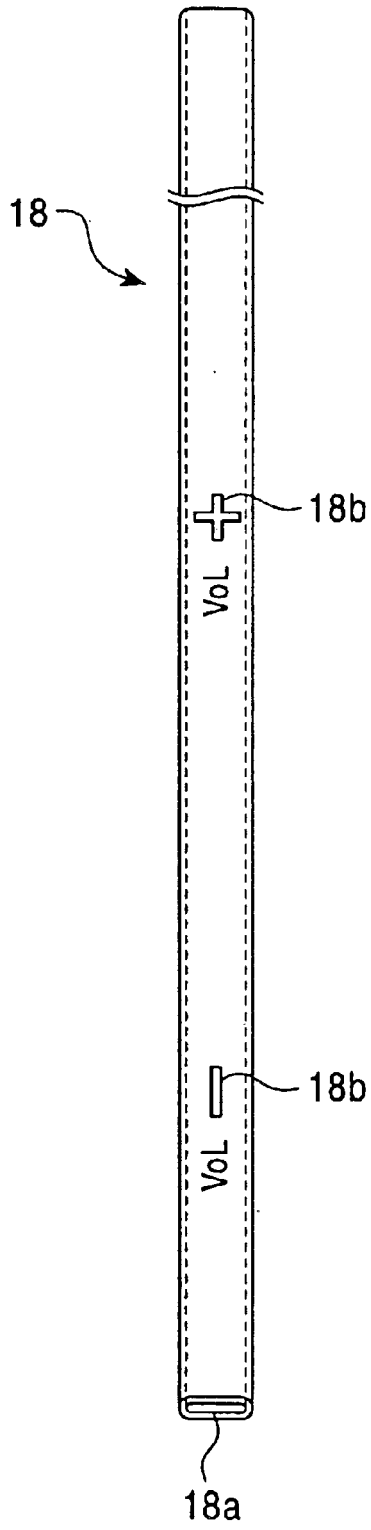
FIG. 12 is an explanatory view of the other cover member.

The cover members 17 and 18 are provided with narrow insertion holes 17*a* and 18*a* through which the clamping members 11 having the membrane 3 therein extend, as shown in FIGS. 11 and 12.

The cover members 17 and 18 are also provided with marks 17*b* and 18*b* shown in FIGS. 11 and 12 that are formed, for example, by printing on the surfaces thereof close to the lower left ends.

The marks 17*b* and 18*b* are provided on both surfaces or on the outer surfaces of the cover members 17 and 18.

When the outer peripheral portions of the clamping members 11 having the membrane 3 therebetween are covered with the cover members 17 and 18 by inserting the clamping members 11 in the insertion holes 17*a* and 18*a*, the input sections 10 are positioned corresponding to the marks 17*b* and 18*b*.

Support holes 19 are provided through both end portions of the cover members 17 and 18, as shown in FIG. 10. Through holes (not shown) are also provided in the clamping members 11 and the first and second substrate units 8 and 9 corresponding to the support holes 19.

Support pins 21*f* of a first connecting member 20 and support pins 32*d* of a second connecting member 31, which will be described later, are passed through the support holes 19, so that both end portions of the clamping members 11 can be connected.

The left end portions of the above-described clamping members 11 shown in FIG. 10 are connected to the first connecting member 20. The first connecting member 20 includes a case 21 having a substantially circular outline, as shown in FIGS. 13 to 17.

Figure 13:
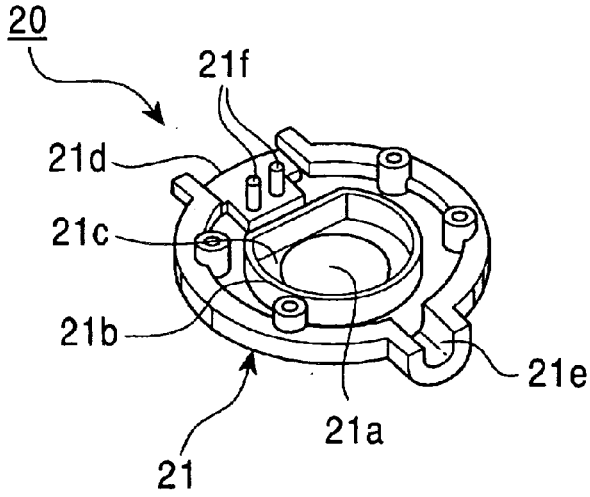
FIG. 13 is a perspective view of a case that constitutes a first connecting member in the input device.

As shown in FIG. 13, a through hole 21*a* is provided at almost the center of the back side of the case 21. A substantially D-shaped wall 21*b* is provided around the through hole 21*a*, and a recess 21*c* having a predetermined depth is provided inside the wall 21*b*.

A first holding groove 21*d* is provided on the inner left side of the case 21 in the figure to hold one-end portions of the clamping members 11 covered with the cover members 17 and 18 and placed one on another. A second holding groove 21*e* is provided on the right front side in the figure of the case 21 opposing the first holding groove 21*d* to hold a cable 27 which will be described later.

Two support pins 21*f* having a predetermined height protrude at the first holding groove 21*d* of the case 21.

Figure 14:
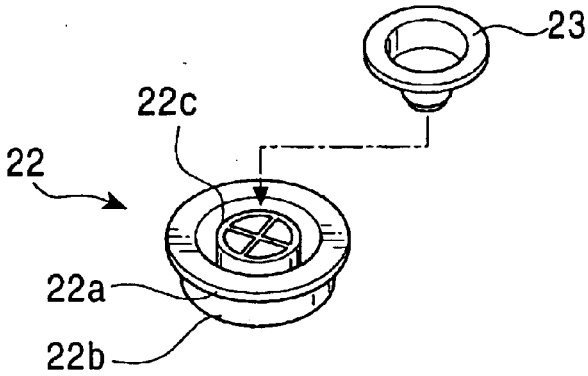
FIG. 14 is a perspective view of a key top that constitutes the first connecting member.

A key top 22 shown in FIG. 14 can be placed on the front side of the case 21 opposite to the recess 21*c*. The key top 22 includes a flange portion 22*a* having a substantially circular outline, and a switch-operating portion 22*b* to be disposed in the through hole 21*a*. The flange portion 22*a* has a rubber fitting portion 22*c*. A waterproof rubber 23 is press-fitted in the rubber fitting portion 22*c* so that the front side of the case 21 is made waterproof.

Figure 15:
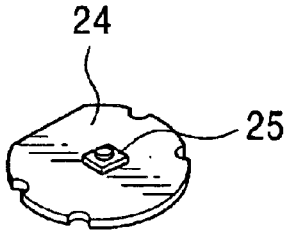
FIG. 15 is a perspective view of a substrate that constitutes the first connecting member.

An insulating substrate 24 shown in FIG. 15 can be placed on the wall 21*b* on the back side of the case 21 shown in FIG. 13. A pushbutton switch member 25, such as a tactile switch, is provided at almost the center of one side of the substrate 24. An FPC connector 26 is connected and fixed to the other side of the substrate 24, for example, by soldering, and the terminal 4 of the membrane 3 can be plugged in the FPC connector 26.

A plurality of lead-soldering portions 24*a* and cable-soldering portions 24*b* are also provided on the other side of the substrate 24.

Figure 17:
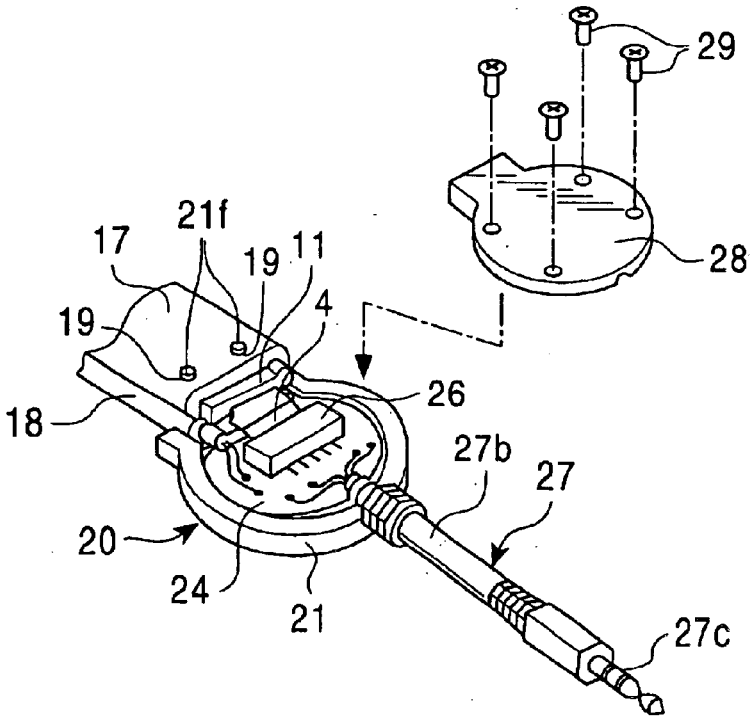
FIG. 17 is a perspective view showing an assembly state of the first connecting member.

When such a substrate 24 is placed on the wall 21*b* with the FPC connector 26 facing upward, as shown in FIG. 17, the switch member 25 is disposed at the through hole 21*a*. The switch member 25 is allowed to be turned on and off by the switch operating portion 22*b* of the key top 22.

Figure 16:
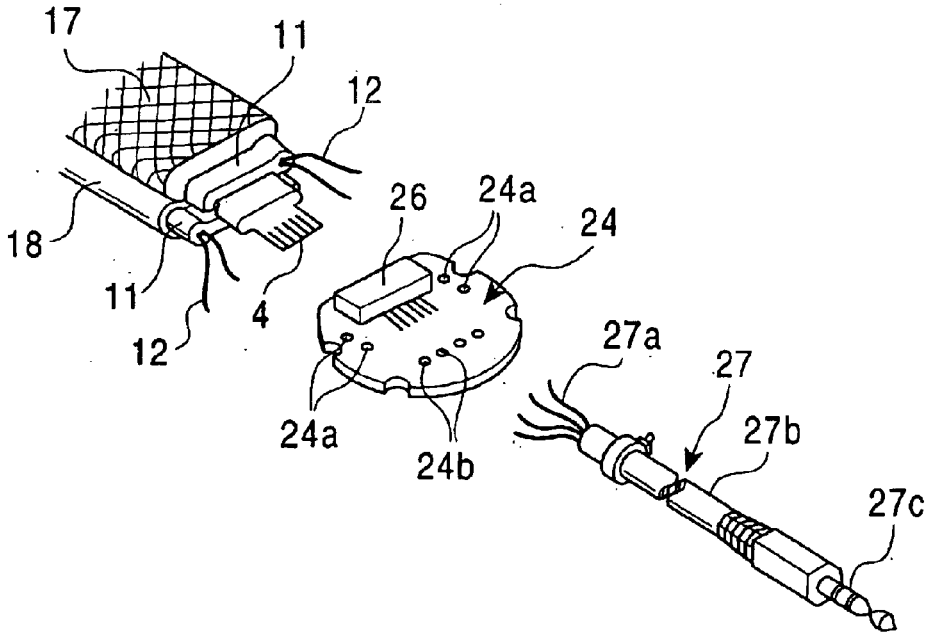
FIG. 16 is an exploded perspective view showing the first connecting member.

A cable shown in FIG. 16 can be soldered to the cable soldering portions 24*b* of the substrate 24. A plug 27*c* is connected to the cable 27 through connecting portions 27*a* that can be soldered to the cable soldering portions 24*b*, and a cable portion 27*b* having a predetermined length.

As shown in FIG. 17, a back lid 28 is provided to cover the back side of the substrate 24. The back lid 28 is fixed to the case 21 with a plurality of screws 29, so that the back side of the case 21 can be made waterproof by a waterproof packing that is not shown.

That is, the interior of the case 21 of the first connecting member 20 is made waterproof by the waterproof rubber 23 and the back lid 28.

In order to connect the one-end portions of the clamping members 11 with such a first connecting member 20, first, the one-end portions of the clamping members 11 are placed one on another, and are put in the first holding groove 21*d*. Then, the terminal 4 is inserted in the FPC connector 26, and the support holes 19 are fitted on the support pins 21*f*, thereby preventing the one-end portions of the clamping members 11 from falling off the case 21.

The leads 12 extending from the one-end portions of the clamping members 11 are connected to the lead soldering portions 24*a* by soldering.

The connecting portions 27*a* of the cable 27 are soldered to the cable soldering portions 24*b*. After that, the one-end portions of the clamping members 11 can be connected with the first connecting member 20 by closing the back side of the case 21 by the back lid 28.

The cable 27 connected to the first connecting member 20 can be connected to an external device 30 such as a portable acoustic device, for example, by inserting the plug 27*c* in a jack (not shown) of the external device 30, as shown in FIG. 1.

The right other-end portions of the clamping members 11 shown in FIG. 10 are connected to the second connecting member 31. The second connecting member 31 includes a case 32 having a substantially rectangular outline, as shown in FIGS. 18 to 21.

Figure 18:
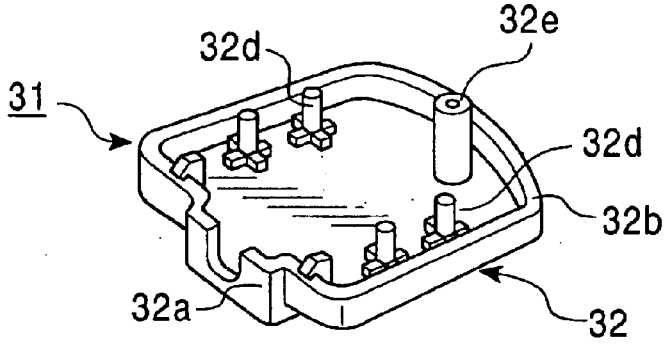
FIG. 18 is a perspective view of a case that constitutes a second connecting member in the input device.
Figure 19:
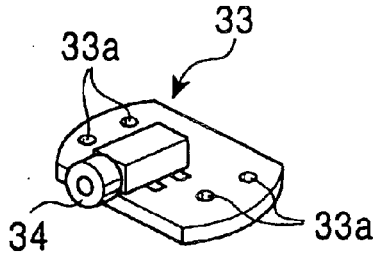
FIG. 19 is a perspective view of a substrate that constitutes the second connecting member.

As shown in FIG. 18, the case 32 has a jack support portion 32*a* at one end, and is surrounded by a peripheral wall 32*b* having a predetermined height.

The case 32 is shielded by a bottom wall 32*c* at the bottom, and is open at the top. Four support pins 32*d* and a support rod 32*e* having predetermined heights protrude from the bottom wall 32*c*.

A substrate 33 having a substantially oval outline can be attached to the case 32. The substrate 33 has support holes 33*a* that can be fitted on the support pins 32*d* of the case 32.

An earphone jack 34 is provided on the center of one side of the substrate 33, in which a plug 40 of an earphone 37, which will be described later, can be inserted. The earphone jack 34 is soldered to a soldering through hole (not shown) provided on the substrate 33.

Figure 20:
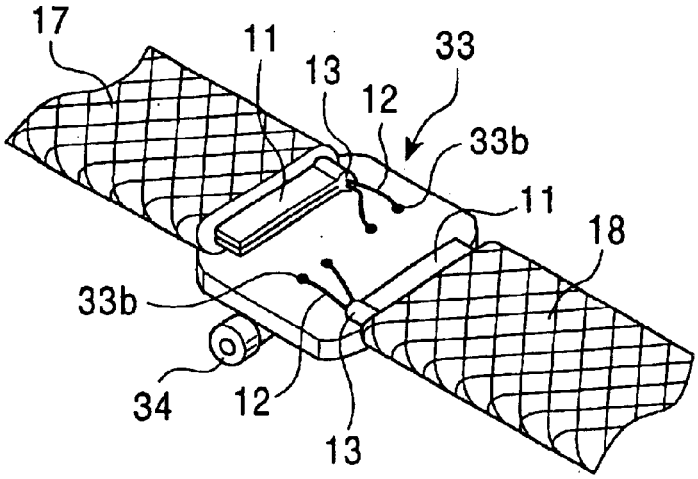
FIG. 20 is a perspective view showing a state in which leads are connected to the back side of the substrate shown in FIG. 19.

Soldering through holes 33*b* are provided on the other side of the substrate 33 with the earphone jack 34 disposed on the lower side, as shown in FIG. 20. The leads 12 extending from the other-end portions of the clamping members 11 can be soldered to the soldering through holes 33*b*.

When the substrate 33 to which the leads 12 are soldered is placed inside the peripheral wall 32*b* of the case 32 in a state in which the earphone jack 34 is disposed on the lower side, the earphone jack 34 is placed at the jack support portion 32*a*, and is positioned inside the case 32 with the support pins 32*d* fitted in the support holes 33*a*, as shown in FIG. 20.

Figure 21:
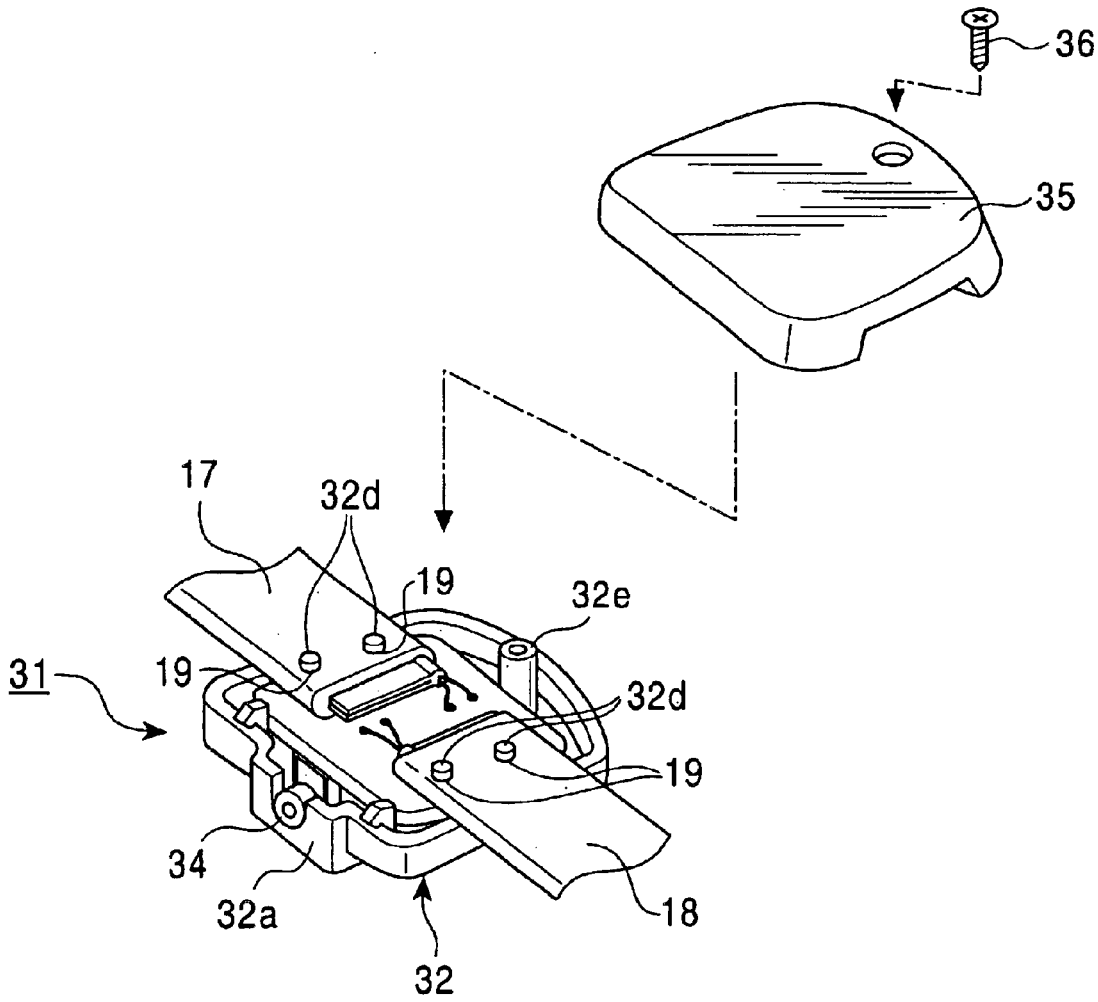
FIG. 21 is a perspective view showing an assembly state of the second connecting member.
Figure 22:
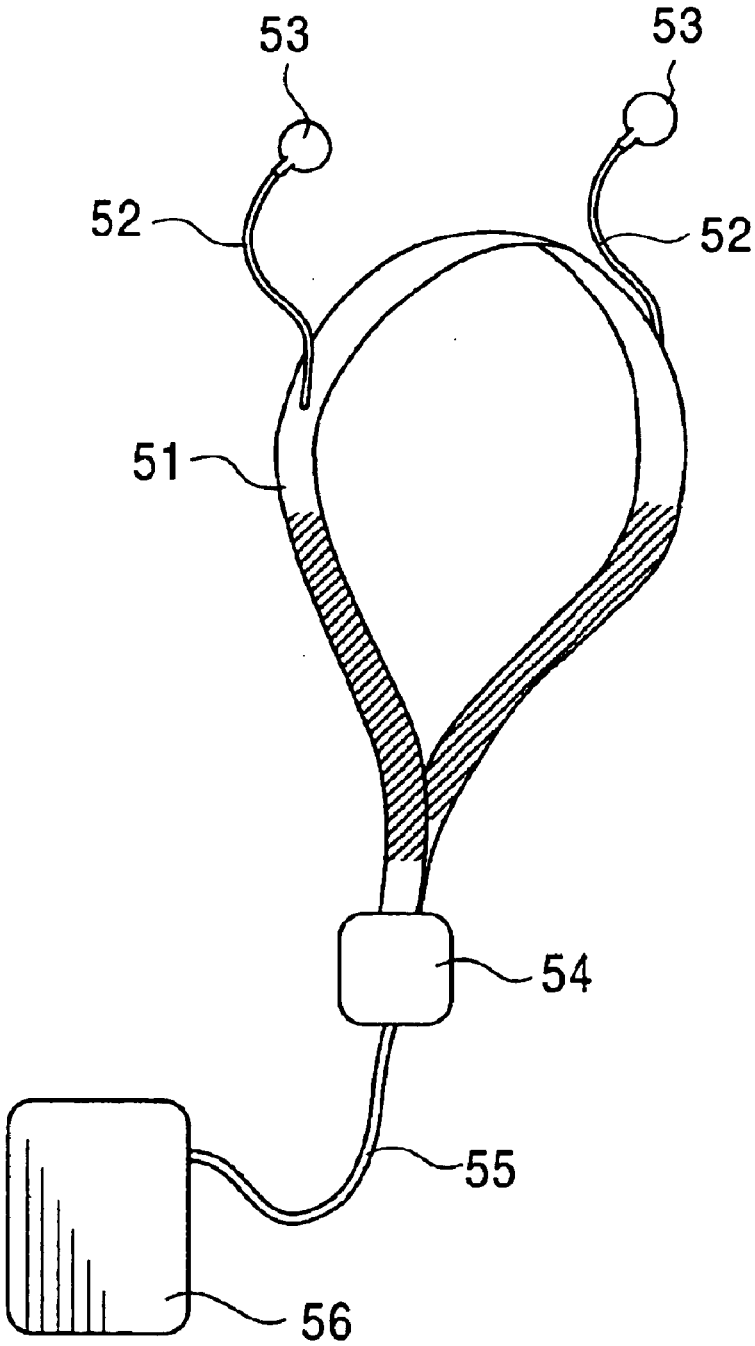
FIG. 22 PRIOR ART
FIG. 22 is a perspective view of a known input device.

As shown in FIG. 21, a cover 35 is attached to the case 32 with a screw 36 to close the open top of the case 32.

Consequently, the interior of the case 32 in which the substrate 33 is positioned by the support pins 32*d* is made waterproof with a waterproof packing (not shown).

The above-described clamping members 11 covered with the cover members 17 and 18 are connected to the first connecting member 20 at one end, and to the second connecting member 31 at the other end, thereby making the strap section 2 annular.

The earphone 37 can be connected to the earphone jack 34 of the second connecting member 31, as shown in FIG. 1. The earphone 37 includes a pair of earphone portions 38, cable portions 39 connected to the earphone portions 38, and an earphone plug 40 that are connected to the cable portions 39 and that are capable of being inserted in the earphone jack 34 of the second connecting member 31.

The annular strap section 2 can be worn around the neck of the operator. When the strap section 2 is worn so that the second connecting member 31 is placed on the neck side of the operator, the first connecting member 20 and the input sections 10 (marks 17*b* and 18*b*) are disposed on the chest side of the operator. Therefore, the switch member 25 of the first connecting member 20 and the input sections 10 of the strap section 2 are placed in an area such that they can be operated by the hand of the operator.

That is, the strap section 2 is wearable around the neck. When the strap section 2 is worn around the neck with the second connecting member 31 on the neck side, the input sections 10 and the switch member 25 are placed in an area such that they can be operated by hand.

Operation of such an input device 1 of the present invention will be described. First, the annular strap section 2 is worn around the neck of the operator so that the second connecting member 31 having the earphone jack 34, in which the earphone plug 40 of the earphone 37 is fitted, is placed at the back of the neck of the operator.

The first connecting member 20 is thereby placed adjacent to the chest of the operator, and the input sections 10 of the strap section 2 are also placed at the positions above the first connecting member 20 such that they can be operated by the hand of the operator. In this case, the external device is held in a pocket, a bag, or the like.

By pressing the waterproof rubber 23 disposed on the front side of the first connecting member 20, the switch member 25 is turned on to drive or stop the external device 30. When the external device 30 is, for example, a portable acoustic device for a CD, the playback of the CD can be started or stopped by turning the switching member 25 on and off.

By pinching one of the marks 17*b* between the fingers, the input section 10 corresponding to the mark 17*b* is operated, for example, to control the volume. By operating the other mark 18*b*, for example, skipping or back-skipping can be performed.

Since the strap section 2 has a plurality of input sections 10 in the input device 1, a plurality of operations can be performed by operating the input sections 10 without taking the external device 30 out of the bag or the like. This provides high usability.

While the strap section 2 is made annular by connecting the end portions of the clamping members 11 by the first and second connecting members 20 and 31 in the above embodiment, in another embodiment, it may be made annular by placing both end portions of a single elongated clamping member (not shown) one on another and connecting the end portions by a single connecting member.

In this case, although not shown, the two earphone portions 38 of the earphone may be connected to the leads 12 extended from the right and left portions of the annular strap section. In such an input device (not shown) of another embodiment, the second connecting member 31 described in the above embodiment is unnecessary, and the number of components can be reduced.

While the clamping members 11 having the membrane 3 sandwiched therein are covered with the cover members 17 and 18 in the above description, they may be exposed without the cover members 17 and 18. In such an input device, the marks 17*b* and 18*b* may be provided in the form of projections or pits simultaneously with shaping of the clamping members 11. By making the marks 17*b* and 18*b* in the form of projections or pits, the operator can operate the input sections without seeing the marks 17*b* and 18*b*.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An input device comprising:

a belt-shaped strap section having a lead buried therein; and a connecting member for connecting the strap section in an annular form, wherein the strap section comprises:

a sheet-shaped membrane having a plurality of input sections; and a belt-shaped clamping member that hermetically sandwiches portions of the membrane having the input sections, and wherein one end of the membrane extends from an end portion of the clamping member to be connected to an external device with the connecting member therebetween.

2. An input device according to claim 1, wherein the clamping member comprises:

a lead-containing portion in which the lead is buried in a longitudinal direction; and a pair of opposing clamping plates extending along the lead-containing portion to hermetically sandwich the membrane.

3. An input device according to claim 2, wherein one side of each of the clamping plates is provided integrally with the lead-containing portion, other sides of the clamping plates are spaced from each other with a predetermined distance, and the membrane is hermetically sandwiched by thermofusing the other sides of the clamping plates.

4. An input device according to claim 2, wherein the membrane hermetically sandwiched between the clamping plates is formed by folding a comb-shaped sheet substrate to form opposing portions, the input sections include contact portions provided on the opposing portions of the substrate, and an outer peripheral portion of each of the contact portions is overcoated with an insulating resist film to expose a predetermined area.

5. An input device according to claim 4, wherein thin portions of the clamping plates corresponding to the contact portions are elastically deformable.

6. An input device according to claim 1, wherein the strap section further comprises another darning member, the connecting member includes a first connecting member for connecting one-end portions of the clamping members, and a second connecting member for connecting the other-end portions of the clamping members, and the strap section is shaped in the annular form by connecting the clamping members with the first and second connecting members.

7. An input device according to claim 6, wherein the lead and the membrane extend from each of the one-end portions of the clamping members and are connected to the first connecting member, and the lead extends from each of the other-end portions of each of the clamping members and is connected to the second connecting member.

8. An input device according to claim 6, wherein the first connecting member has a switch member that switches the connection between the external device and the input sections of the membrane.

9. An input device according to claim 6, wherein the membrane extending from the one end of each of the clamping members has a terminal to be connected to a flexible printed circuit connector provided in the first connecting member.

10. An input device according to claim 6, wherein the second connecting member has an earphone jack to which an earphone is connectable.

11. An input device according to claim 10, wherein the second connecting member has a jack substrate on which the earphone jack is mounted, and hermetically seals the jack substrate therein.

12. An input device according to claim 1, wherein an outer peripheral portion of the clamping member is covered with a cover member.

13. An input device according to claim 12, wherein the cover member has marks corresponding to the input sections.

14. An input device according to claim 8, wherein the strap section is wearable around a neck, and the input sections and the switch member are positioned so as to be operated by hand when the strap section is worn around the neck with the second connecting member placed on the neck side.

15. An input device according to claim 3, wherein the membrane hermetically sandwiched between the clamping plates is formed by folding a comb-shaped sheet substrate to form opposing portions, the input sections include contact portions provided on the opposing portions of the substrate, and an outer peripheral portion of each of the contact portions is overcoated with an insulating resist film to expose a predetermined area.

16. An input device according to claim 15, wherein thin portions of the clamping plates corresponding to the contact portions are elastically deformable.

* * * * *